US007032693B2

(12) United States Patent
Siracki

(10) Patent No.: US 7,032,693 B2
(45) Date of Patent: Apr. 25, 2006

(54) PREFORMED TOOTH FOR TOOTH BIT

(75) Inventor: Michael A. Siracki, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 10/634,629

(22) Filed: Aug. 5, 2003

(65) Prior Publication Data

US 2004/0108145 A1 Jun. 10, 2004

Related U.S. Application Data

(60) Provisional application No. 60/407,142, filed on Aug. 30, 2002.

(51) Int. Cl.
*E21B 10/16* (2006.01)

(52) U.S. Cl. ..... 175/425; 175/374; 76/108.2

(58) Field of Classification Search ..... 175/425, 175/374, 375; 76/108.2, 5.1
See application file for complete search history.

(56) References Cited

U.S. PATENT DOCUMENTS

| | | | | |
|---|---|---|---|---|
| 4,262,761 | A | 4/1981 | Crow | 175/374 |
| 4,372,404 | A * | 2/1983 | Drake | 175/374 |
| 4,595,067 | A * | 6/1986 | Drake | 175/331 |
| 4,907,665 | A * | 3/1990 | Kar et al. | 175/426 |
| 4,940,099 | A * | 7/1990 | Deane et al. | 175/374 |
| 5,064,007 | A * | 11/1991 | Kaalstad | 175/334 |
| 5,579,856 | A * | 12/1996 | Bird | 175/375 |
| 6,206,115 | B1 * | 3/2001 | Overstreet et al. | 175/374 |
| 6,227,319 | B1 | 5/2001 | Radford | 175/432 |
| 6,450,271 | B1 * | 9/2002 | Tibbitts et al. | 175/374 |

FOREIGN PATENT DOCUMENTS

| | | |
|---|---|---|
| EP | 1081119 | 3/2001 |
| GB | 2328965 | 3/1996 |
| GB | 2357532 | 6/2001 |
| GB | 2361493 | 10/2001 |
| GB | 2375126 | 11/2002 |

* cited by examiner

*Primary Examiner*—Kenneth Thompson
(74) *Attorney, Agent, or Firm*—Osha Liang LLP

(57) ABSTRACT

A method of forming a tooth rock bit is disclosed. In one embodiment, the method includes attaching the at least one cutting element to a surface of a cone, and depositing a hard facing layer on at least one cutting element prior to the attaching.

10 Claims, 2 Drawing Sheets

PREFORMED TOOTH FOR TOOTH BIT

This application claims the benefit, pursuant to 35 U.S.C. §120, of U.S. Provisional Application No. 60/407,142, entitled, "Preformed Tooth for Tooth Bit," filed on Aug. 30, 2002 and is incorporated by reference in its entirety.

BACKGROUND OF INVENTION

1. Field of the Invention

The invention relates generally to preformed teeth for tooth roller cone rock bits.

2. Background Art

Drill bits used to drill wellbores through earth formations generally are made within one of two broad categories of bit structures. Drill bits in the first category are generally known as "fixed cutter" or "drag" bits, which usually include a bit body formed from steel or another high strength material and a plurality of cutting elements disposed at selected positions about the bit body. The cutting elements may be formed from any one or combination of hard or superhard materials, including, for example, natural or synthetic diamond, boron nitride, and tungsten carbide.

Drill bits of the second category are typically referred to as "roller cone" rock bits, which usually include a bit body having one or more roller cones rotatably mounted to the bit body. There are generally two "types" of roller cone cutting structures in the roller cone rock bits, the first being a tungsten carbide insert bit, (known as a TCI bit) and the second type being a tooth bit. In either case, the bit body is typically formed from steel or another high strength material. The roller cones are also typically formed from steel or other high strength material and include a plurality of cutting elements disposed at selected positions about the cones.

The cutting elements for TCI bits are commonly known as inserts or compacts and are typically made out of a hard material such as tungsten carbide with a cobalt binder and are typically press-fitted into holes drilled in the cones.

The process of which the method for making such inserts is commonly known in the art. The cutting elements for a tooth cone are commonly known as "teeth," and are typically machined or formed into the cone. In typical applications, a layer of hardmetal is applied to the teeth to extend the wear life of the teeth.

Under normal drilling conditions, the relatively soft steel teeth of a milled-tooth cones are exposed to substantial abrasion and loading. This abrasion and loading can result in significant erosion and impact wear on the teeth. The wear on the teeth ultimately results in a reduction in the penetration rate of the drill bit and a shortened life of the drill bit.

A solution to the lack of wear resistance is to deposit a coating of wear-resistant material on the surfaces of the teeth. This process is sometimes referred to in the art as "hardfacing."

Application of hardfacing to the base material from which the cones and drill bit are formed is known in the art. Typically, a hardfacing material is applied, such as by arc or gas welding, to the exterior surface of the teeth to improve the wear resistance of the teeth. The hardfacing material typically includes one or more metal carbides, which are bonded to the steel teeth by a metal alloy ("binder alloy"). In effect, the carbide particles are suspended in a matrix of metal forming a layer on the surface. The carbide particles give the hardfacing material hardness and wear resistance, while the matrix metal provides fracture toughness to the hardfacing.

Many factors affect the durability of a hardfacing composition in a particular application. These factors include the chemical composition and physical structure (size and shape) of the carbides, the chemical composition and microstructure of the matrix metal or alloy, and the relative proportions of the carbide materials to one another and to the matrix metal or alloy.

The metal carbide most commonly used in hardfacing is tungsten carbide.

Small amounts of tantalum carbide and titanium carbide may also be present in such material, although these other carbides are considered to be deleterious. It is quite common to refer to the material in the hardfacing merely as "carbide" without characterizing it as tungsten carbide. It should be understood that as used herein, "carbide" generally means tungsten carbide.

Many different types of tungsten carbides are known based on their different chemical compositions and physical structure. Three types of tungsten carbide commonly employed in hardfacing drill bits are: cast tungsten carbide, macro-crystalline tungsten carbide, and cemented tungsten carbide (also known as sintered tungsten carbide). The most common among these is possibly crushed cast carbide.

Tungsten forms two carbides, monotungsten carbide (WC) and ditungsten carbide (W2C). Tungsten carbide may also exist as a mixture of these two forms with any proportion between the two. Cast carbide is a eutectic mixture of the WC and W2C compounds, and as such the carbon content in cast carbide is substoichiometric, i.e., it has less carbon than the more desirable WC form of tungsten carbide. Cast carbide is prepared by freezing carbide from a molten state and crushing and comminuting the resultant particles to the desired particle size.

Macro-crystalline tungsten carbide is essentially stoichiometric WC in the form of single crystals. While most of the macro-crystalline tungsten carbide is in the form of single crystals, some bicrystals of WC are found in larger particles. Macro-crystalline WC is a desirable hardfacing material because of its toughness and stability.

The third type of tungsten carbide used in hardfacing is cemented tungsten carbide, also known as sintered tungsten carbide. Cemented tungsten carbide comprises small particles of tungsten carbide (e.g., 1 to 15 microns) bonded together with cobalt. Cemented tungsten carbide is made by mixing organic wax, tungsten carbide and cobalt powders, pressing the mixed powders to form a green compact, and "sintering" the composite at temperatures near the melting point of cobalt. The resulting dense cemented carbide can then be crushed and comminuted to form particles of cemented tungsten carbide for use in hardfacing.

In addition to these three types of commonly used carbides, carburized tungsten carbide may also be used to provide desired property. Other compositions for hardfacing are disclosed, for example in U.S. Pat. No. 4,836,307 issued to Keshavan et al., and U.S. Pat. No. RE 37,127 issued to Schader et al.

As mentioned above, conventional hardfacing usually comprises particles of tungsten carbide bonded to the steel teeth by a metal alloy. In effect, the carbide particles are suspended in a matrix of metal forming a layer on the surface. Most hardfacing on rock bits employs steel as the matrix, although other alloys may also be used. Such steel or other alloys will be generally referred to as a binder alloy. Hardfacing compositions are typically applied from tube rods, for example as disclosed in U.S. Pat. No. 5,250,355 issued to Newman et al.

A typical technique for applying hardfacing to the teeth on a rock bit is by oxyacetylene or atomic hydrogen welding. A welding "rod" or stick is typically formed of a tube of mild steel sheet enclosing a filler which mainly comprises carbide particles. The filler may also include deoxidizer for the steel, flux and a resin binder. The hardfacing is applied by melting an end of the rod on the face of the tooth. The steel tube melts to weld to the steel tooth and provide the matrix for the carbide particles. The deoxidizer alloys with the mild steel of the tube.

Although mild steel sheet is used when forming the tubes, the steel in the hardfacing on a finished a rock bit is a hard, wear resistant alloy steel. The conversion from a mild steel to the hard, wear resistant alloy steel occurs when the deoxidizers (which contain silicon and manganese) in the filler and tungsten, carbon, and possibly cobalt, from the tungsten carbide dissolve and mix with the steel during welding. There may also be some mixing with alloy steel from the teeth on the cone.

However, the above processes do not always produce satisfactory hardfacing coatings on milled teeth. Quality characteristics of a hardfacing coating are indicated, in part, by the thickness, uniformity, and coverage of the hardfacing coating on the tooth. The quality also is affected by the porosity of and the oxide and eta phase content in the coating. In a typical prior art process, the consistency of these characteristics varies from operator to operator and even from time to time for the same operator. Sometimes the quality of a hardfacing coating may differ significantly from one tooth to another on the same cone.

What is needed, therefore, are rock bits having consistent hardfacing layers, which can be used for a variety of applications, and methods for manufacturing the same.

SUMMARY OF INVENTION

In one aspect, the present invention relates to a method of forming a tooth rock bit. In one embodiment, the method includes attaching the at least one cutting element to a surface of a cone, and depositing a hardfacing layer on at least one cutting element prior to the attaching.

Other aspects and advantages of the invention will be apparent from the following description and the appended claims.

DETAILED DESCRIPTION

The present invention relates to tooth roller cone drill bits and method of making the same. In particular, some embodiments of the present invention involve preforming individual cutting elements ("teeth"), applying hardfacing to the cutting elements, and attaching the individual cutting elements to the cone. In a preferred embodiment, individual cutting elements are attached to the cone by electron beam welding. The term "tooth" roller cone bit or "tooth" bit, as used herein is used to distinguish the present invention from insert bits.

However, other methods of attachment are expressly within the scope of the present invention. In particular, methods such as friction welding and brazing are expressly within the scope of the present invention. In the prior art, the cutting elements on a tooth bit are formed integral with the cones. A hardfacing layer, as described above, was then applied to the teeth protruding from the surface of the cone.

Applying hardfacing in this manner (which is typically done manually), is difficult due to the limited access to the teeth which generally leads to an uneven application of hardfacing layers. Also, in typical prior art applications, welding hardfacing to the parent tooth may degrade the hardmetal when too much heat is applied. Further, improper bonding may result if too little heat is applied. In contrast, in methods of the present invention, hardfacing is applied to individual cutting elements prior to being welded onto the cone. By applying hardfacing to the individual cutting elements, uniformity in thickness can be achieved. Furthermore, automatic techniques for applying hardfacing may be more readily implemented with the present invention.

Figure 1:
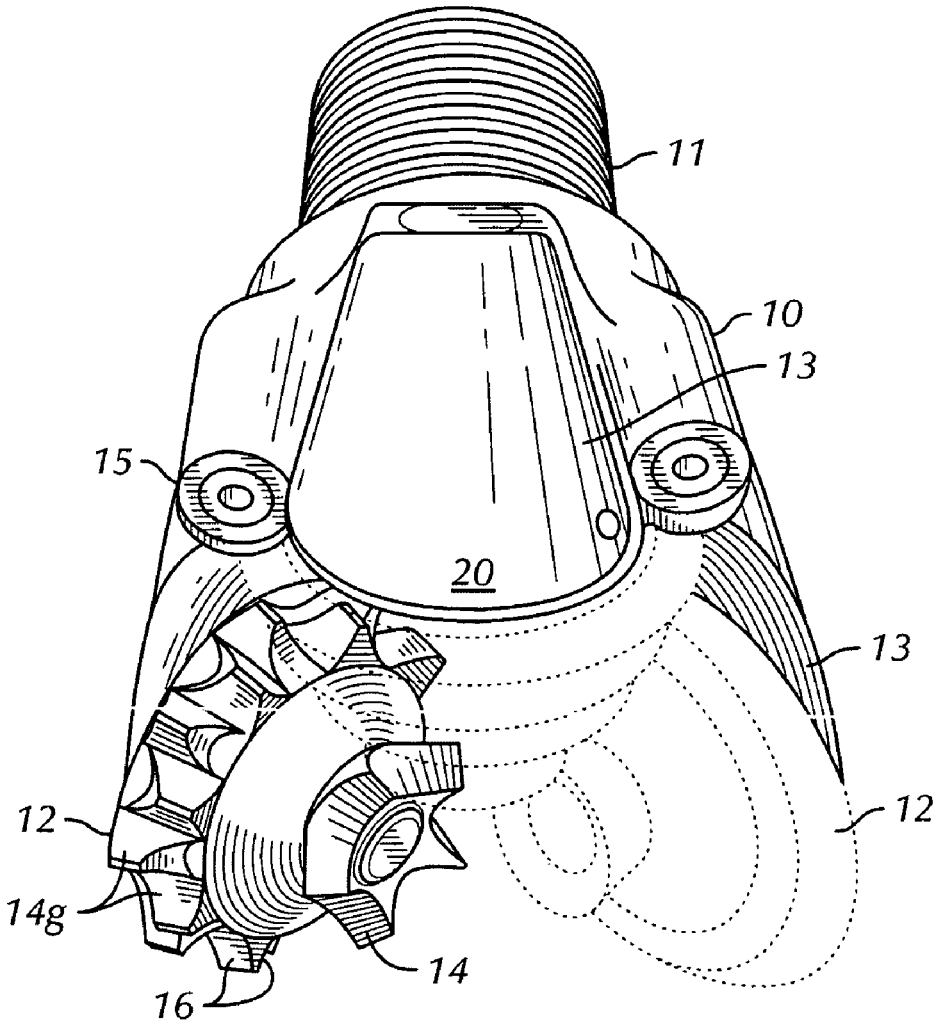
FIG. 1 shows a tooth rock bit formed in accordance with an embodiment of the present invention.

FIG. 1 shows an example of a tooth roller cone drill bit that includes a steel body 10 having a threaded coupling ("pin") 11 at one end for connection to a conventional drill string (not shown). At the opposite end of the drill bit body 10 there are three roller cones 12, for drilling earth formations to form an oil well or the like ("wellbore"). Each of the roller cones 12 is rotatably mounted on a journal pin (not shown in FIG. 1) extending diagonally inwardly on each one of the three legs 13 extending downwardly from the bit body 10. As the bit is rotated by the drill string (not shown) to which it is attached, the roller cones 12 effectively roll on the bottom of the wellbore being drilled. The roller cones 12 are shaped and mounted so that as they roll, teeth 14 on the cones 12 gouge, chip, crush, abrade, and/or erode the earth formations (not shown) at the bottom of the wellbore. The teeth 14G in the row around the heel of the cone 12 are referred to as the "gage row" teeth. They engage the bottom of the hole being drilled near its perimeter or "gage." Fluid nozzles 15 direct drilling fluid ("mud") into the hole to carry away the particles of formation created by the drilling.

A roller cone rock bit as shown in FIG. 1 is merely one example of various arrangements that may be used in a rock bit which is made according to the invention. For example, most roller cone rock bits have three roller cones as illustrated in FIG. 1. However, one, two and four roller cone drill bits are also known in the art. Therefore, the number of such roller cones on a drill bit is not intended to be a limitation on the scope of the invention.

Figure 2:
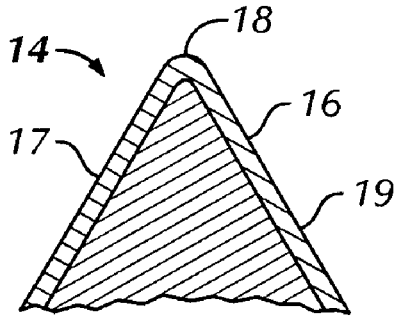
FIG. 2 shows a tooth formed in accordance with one embodiment of the present invention.

The example teeth on the roller cones shown in FIG. 1 are generally triangular in a cross-section taken in a radial plane of the cone. Referring to FIG. 2, such a tooth 14 has a leading flank 16 and a trailing flank 17 meeting in an elongated crest 18. The flank of the tooth 14 is covered with a hardfacing layer 19. Sometimes only the leading face of each such tooth 14 is covered with a hardfacing layer so that differential erosion between the wear-resistant hardfacing on the front flank of a tooth and the less wear-resistant steel on the trailing face of the tooth tends to keep the crest of the tooth relatively sharp for enhanced penetration of the rock being drilled.

The leading flank 16 of the tooth 14 is the face that tends to bear against the undrilled rock as the rock bit is rotated in the wellbore. Because of the various cone angles of different teeth on a roller cone relative to the angle of the journal pin on which each cone is mounted, the leading flank on the teeth in one row on the same cone may face in the direction of rotation of the bit, whereas the leading flank on teeth in another row may on the same cone face away from the direction of rotation of the fit. In other cases, particularly near the axis of the bit, neither flank can be uniformly regarded as the leading flank and both flanks may be provided with a hardfacing.

There are also times when the ends of a tooth, that is, the portions facing in more or less an axial direction on the cone, are also provided with a layer of hardfacing. This is particularly true on the so-called gage surface of the bit which is often provided with a hardfacing. The gage surface is a generally conical surface at the heel of a cone which engages the side wall of a hole as the bit is used. The gage surface includes the outer end of teeth in the so-called gage row of teeth nearest the backface of the cone. The gage surface encounters the side wall of the hole in a complex scraping motion which induces wear of the gage surface. In some drill bits, hardfacing may also be applied on the shirttail (20 in FIG. 1) at the bottom of each leg on the bit body.

Figure 3:
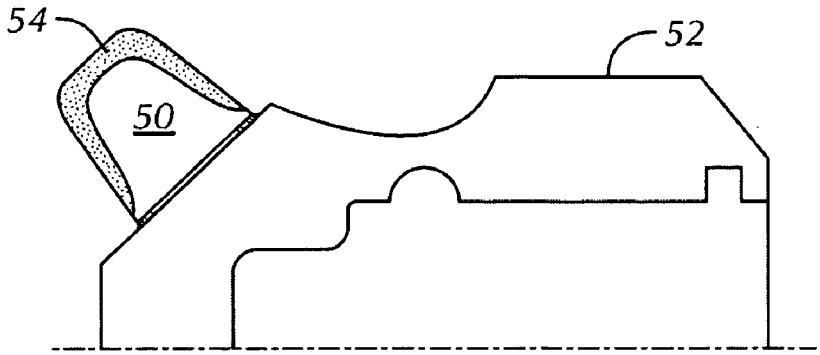
FIG. 3 shows a tooth formed in accordance with one embodiment of the present invention.

FIG. 3 shows a single tooth 50 formed in accordance with the present invention disposed on a cone 52. A hardfacing layer 54 is shown as being deposited over the surface of tooth 50. Hardfacing materials which can be used in a roller cone made according to embodiments of the invention include sintered or cast tungsten carbide, for example. Other wear resistant refractory materials known in the art may also be used for the hardfacing layer 54.

In general, the hardfacing can be any material which can be metallurgically or mechanically bonded to the material selected for the tooth 50 and which is harder than the tooth 50. A preferred thickness for the hardfacing layer 20 ranges from about 0.030 to 0.180 inches. Other thicknesses for the hardfacing may be used in other embodiments. The thickness selected for any particular basic bit structure depends on the drilling application and the abrasiveness of the formation to be drilled, among other factors.

Figure 4A:
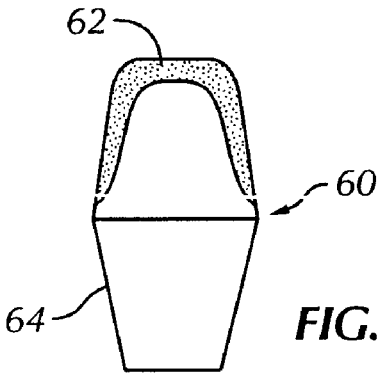
FIGS. 4*a* and 4*b* show a tooth and cone formed in accordance with one embodiment of the present invention.
Figure 4B:
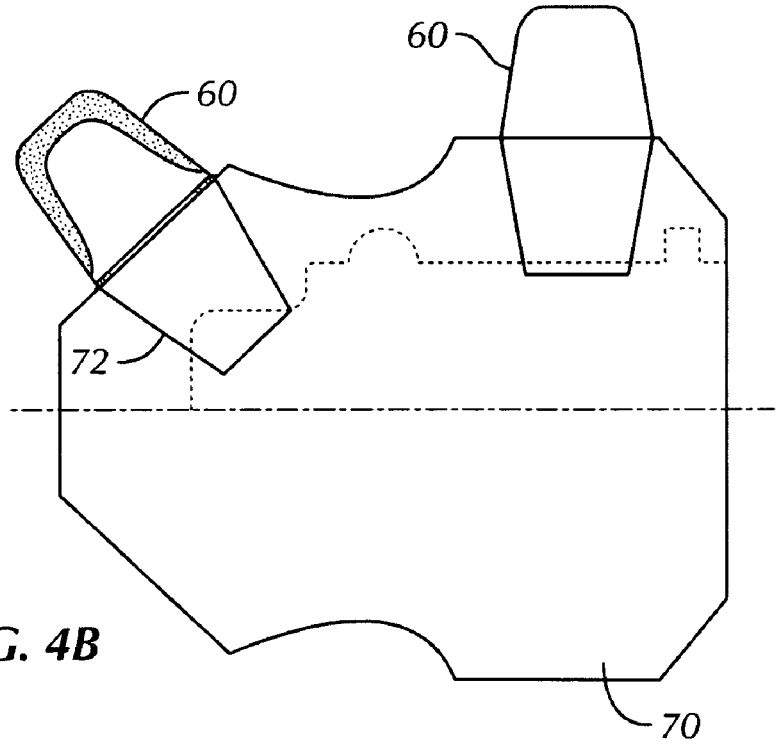

According to the present invention, as illustrated in FIGS. 4*a* and 4*b*, a bit structure (as shown in FIGS. 1 and 2) is formed by preforming at least one cutting element 60. The at least one cutting element 60 includes preformed hardfacing layer 62. In a preferred embodiment (illustrated in FIG. 4*a*), the at least one cutting element has a tapered or cylindrical base 64 that is adapted to be inserted into a roller cone 70 (FIG. 4*b*). However, in other embodiments, the at least one cutting element may be directly welded onto a surface of a cone.

The manner in which the hardfacing is applied to the tooth is also a matter of choice for the bit designer, and may include, for example, HVOF spraying, high velocity air fuel (HVAF) spraying, welding, flame spray, plasma arc, plasma-transferred arc, sintering, furnace brazing, furnace fusing, pressure assisted sintering, reaction bonding, among others. Notably, because the hardfacing is applied to a single cutting element, different techniques (including automated techniques) may be used for different cutting elements. Further, in some embodiments, it may be desirable that different cutting elements have hardfacing layers formed from different materials.

The technique actually used to apply the hardfacing should at least result in the formation of a mechanical bond to the substrate and, more preferably, should result in formation of a metallurgical bond to the substrate. Preferred processes for applying the hardfacing to create such a bond include robotic coating and powder forming. The manner in which the hardfacing is applied and the composition or compositions used to form the hardfacing layers discussed herein is not intended to limit the scope of the invention in any fashion.

After the hardfacing layer 62 is applied (in a preferred embodiment, a tungsten carbide composite layer), the at least one cutting element 60 is inserted into a hole 72 machined into the cone 70. After insertion, the at least one cutting element 60 is welded to the cone 70. As noted above, in a preferred embodiment, the at least one cutting element 60 may be welded to the cone 70 using an automated electron beam welding technique. Electron beam welding techniques are known in the art, so further explanation is not provided for the sake of clarity. However, a variety of other techniques, such as friction welding, brazing, or other welding techniques may be used. The particular welding technique used is not intended to limit the scope of the invention.

In addition, a tooth and a hardfacing layer may be formed at substantially the same time. Because the present invention discloses forming teeth separate from the cone, the hardfacing layer may be deposited on at least one preformed tooth at substantially the same time that the tooth is formed.

Advantages of the present invention include, in one or more embodiments, that a hardfacing layer can be applied easier and more uniformly. In addition, because the hardfacing layer is applied to individual teeth, rather than the teeth of the drill bit cone as a whole, it is much easier to automate the process. It is much simpler to engineer a robotic apparatus for applying a hardfacing layer to a single cutting structure than to engineer a robotic apparatus for uniformly applying hardfacing to a complex three dimensional drill bit cone. It is also advantageous to have an optimal designed and controlled interface between the parent tooth and the hardfacing for optimal bonding and life, which is difficult to achieve and maintain when hardfacing the teeth on a cone as opposed to forming the tooth and hardmetal coating together.

Further, the present invention allows individual cutting elements to be replaced, as compared to traditional prior art milled teeth bits. Furthermore, by inserting individual teeth, complex cutting structures can be generated for particular applications. Should a particular application require a particular row arrangement (or a particular number of teeth on a given row), the present invention provides a simple method for creating such a structure. Moreover, by applying hardfacing to a single tooth, the present invention allows a user to change the particular composition of hardfacing being used more readily than in the prior art.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method of forming a tooth for a roller cone rock bit, comprising:

attaching at least one cutting element being predominantly steel to a surface of a cone; and depositing a hardfacing layer on the at least one cutting element prior to the attaching, wherein the hardfacing layer comprises a hardmetal coating and wherein the hardfacing layer is deposited to have a thickness between 0.030 in and 0.180 in.

2. The method of claim 1, wherein at the attaching comprises at least one selected from a group consisting of electron beam welding, friction welding, and brazing.

3. The method of claim 1, wherein the depositing the hardfacing layer comprises at least one selected from a group consisting of high velocity air fuel spraying, flame spray, plasma arc, plasma-transferred arc, sintering, furnace brazing, furnace fusing, pressure assisted sintering and reaction bonding.

4. The method of claim 1, wherein the hardfacing layer comprises at least one material selected from a group consisting of sintered tungsten carbide, cast tungsten carbide, and macro-crystalline tungsten carbide.

5. The method of claim 1, wherein the hardfacing layer has a thickness dependent on properties of formation to be drilled by the tooth rock bit.

6. The method of claim 1, wherein the at least one tooth comprises a gage tooth.

7. The method of claim 1, wherein the depositing of the hardfacing layer comprises automatically applying the hardfacing layer.

8. A method of forming a tooth for a roller cone rock bit, comprising:

attaching at least one cutting element being predominantly steel to a surface of a cone; and depositing a hardfacing layer on the at least one cutting element prior to the attaching, wherein the hardfacing layer comprises a hardmetal coating, wherein the depositing of the hardfacing layer comprises applying the hardfacing layer to a leading face of the at least one tooth.

9. A method of forming a tooth for a roller cone rock bit, comprising:

attaching a first cutting element and a second cutting element both being predominantly steel to a surface of a cone; and depositing a hardfacing layer on the first cutting element and the second cutting element prior to the attaching, wherein the hardfacing layer includes a hardmetal coating, wherein the hardfacing layer deposited on the first cutting element is different from the hardfacing layer deposited on the second cutting element.

10. The method of claim 9, wherein the depositing of the hardfacing layer on the first cutting element is applied differently from the hardfacing layer on the second cutting element.

* * * * *